US009103134B1

(12) United States Patent
Murray et al.

(10) Patent No.: US 9,103,134 B1
(45) Date of Patent: Aug. 11, 2015

(54) ADJUSTABLE OPEN SPACE OFFICE SYSTEM

(71) Applicant: Neuehouse LLC, New York, NY (US)

(72) Inventors: Alan Murray, New York, NY (US); Cristina Azario, New York, NY (US); Nicholas Thatos, Manhasset, NY (US); Michael Siporin, New York, NY (US); David Rockwell, New York, NY (US)

( * ) Notice: Subject to any disclaimer, the term of this patent is extended or adjusted under 35 U.S.C. 154(b) by 0 days.

(21) Appl. No.: 14/265,761

(22) Filed: Apr. 30, 2014

(51) Int. Cl.
*E04H 1/12* (2006.01)

(52) U.S. Cl.
CPC ..... *E04H 1/125* (2013.01)

(58) Field of Classification Search
CPC ..... E04H 1/125; E04H 1/1205; E04H 1/12; E04H 1/1222; E04H 1/1272; E04H 1/1261; E04H 1/1266; E04B 2002/749
USPC ..... 52/79.1, 79.9, 79.12, 106, 238.1, 239, 52/207, 243.1, 270, 656.7
See application file for complete search history.

(56) References Cited

U.S. PATENT DOCUMENTS

| | | | | |
|---|---|---|---|---|
| 2,240,484 | A | 5/1941 | Anderson | |
| 3,117,392 | A | 1/1964 | Junkunc | |
| 3,261,129 | A * | 7/1966 | Brydolf et al. | 49/411 |
| 3,392,497 | A | 7/1968 | Cushman | |
| 3,733,756 | A | 5/1973 | Butler | |
| 4,182,080 | A * | 1/1980 | Naylor | 49/410 |
| 4,424,605 | A * | 1/1984 | Squires et al. | 16/94 R |
| 4,635,811 | A | 1/1987 | Lodi | |
| 4,676,039 | A * | 6/1987 | Leiter et al. | 52/282.4 |
| 5,033,526 | A | 7/1991 | DeLong et al. | |
| 5,159,793 | A * | 11/1992 | Deugo et al. | 52/126.1 |
| 6,581,344 | B1 * | 6/2003 | Niewiadomski et al. | 52/239 |
| 6,715,526 | B1 | 4/2004 | Brownfield et al. | |
| 6,742,307 | B2 | 6/2004 | Briskman | |
| 6,786,017 | B2 | 9/2004 | Thompson | |
| 7,380,879 | B2 | 6/2008 | Fletcher et al. | |
| 7,814,727 | B2 * | 10/2010 | LaCasse | 52/764 |
| 7,934,981 | B2 | 5/2011 | Muggah | |
| 8,176,707 | B2 | 5/2012 | Gosling et al. | |
| 8,215,065 | B2 | 7/2012 | Gallant | |

(Continued)

FOREIGN PATENT DOCUMENTS

| | | | |
|---|---|---|---|
| EP | 0538181 | A1 | 4/1993 |
| EP | 0557092 | A1 | 8/1993 |

*Primary Examiner* — Brian Glessner
*Assistant Examiner* — Adam Barlow
(74) *Attorney, Agent, or Firm* — Brad M. Behar & Associates, PLLC

(57) ABSTRACT

The present invention relates to furniture and devices and a system for forming working areas within open spaces. More specifically, the present invention relates to furniture, devices and systems that can be used to create individual working areas and offices in an open space with the ability to create privacy similar to an enclosed office without constructing permanent walls and partitions. The invention includes a main support frame/structure supported off the floor which receives and connects to component panels also supported off the floor which function like office walls. The configuration of the resulting compartments is adjustable using different sized panels and by positioning panels and opening in different locations. The system has an open top configuration with an upward lighting system integral to the top support member and inside it to provide upward lighting to the space(s). A privacy door slidably connected to the top support member provides the ability to create privacy like an office with permanent walls.

15 Claims, 9 Drawing Sheets

(56) References Cited

U.S. PATENT DOCUMENTS

| | | | | |
|---|---|---|---|---|
| 8,402,699 | B2 * | 3/2013 | Henriott | 52/36.1 |
| 8,550,574 | B2 | 10/2013 | Jensen et al. | |
| 8,955,271 | B2 * | 2/2015 | Keller et al. | 52/207 |
| 8,966,842 | B2 * | 3/2015 | Hager et al. | 52/241 |
| 2005/0087308 | A1 | 4/2005 | Vaughan | |
| 2006/0048457 | A1 | 3/2006 | Yang | |
| 2009/0293391 | A1 | 12/2009 | DeVore | |
| 2010/0205868 | A1 | 8/2010 | Williams et al. | |

* cited by examiner

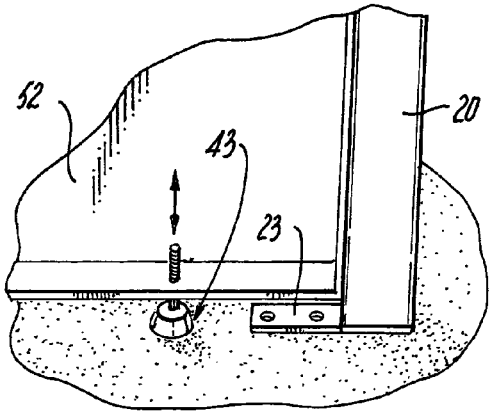
Fig. 4
Fig. 5
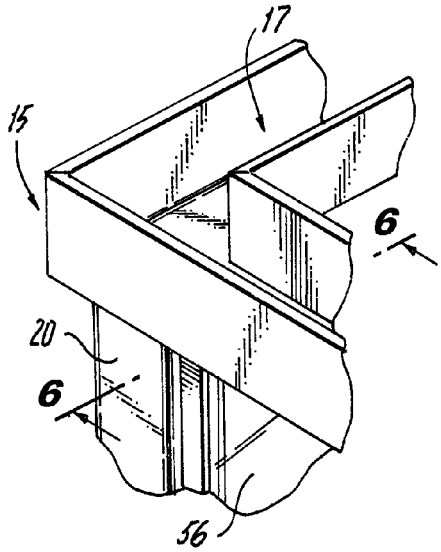
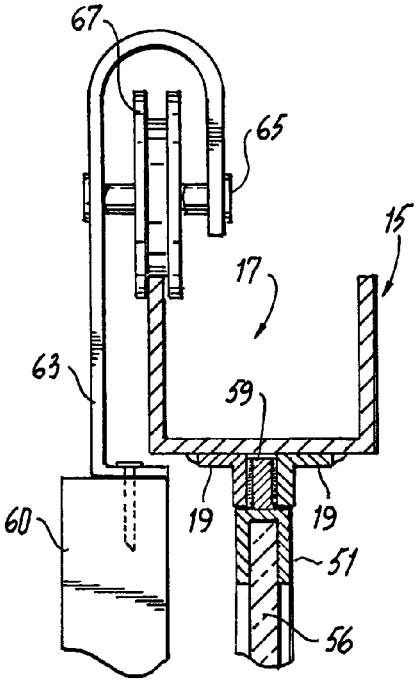
Fig. 7
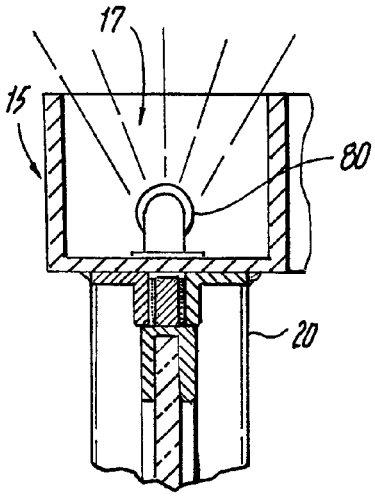
Fig. 6

ADJUSTABLE OPEN SPACE OFFICE SYSTEM

FIELD OF THE INVENTION

The present invention relates to furniture and devices and a system for forming working areas within open spaces. More specifically, the present invention relates to furniture, devices and systems that can be used to create individual working areas and offices in an open space with the ability to create privacy similar to an enclosed office without constructing permanent walls and partitions.

BACKGROUND OF THE INVENTION

Cubicles or office workstations are partially enclosed workspaces that are separated by partitions. The purpose of these workspaces is to create working areas that, to an extent, isolate office workers and reduce distractions in the open workspace setting. They provide desk space so that workers may perform work and focus on their work without too much interruption. Cubicles and other types of open office spaces are a necessity in buildings where there may not be enough private rooms for each individual to have their own office. For economical reasons, and/or due to preference, and/or due to necessity, companies rely on an open office space/environment such as a warehouse or shared space where other companies are using/renting space. In order to divide space and provide office areas with partial walls, desks, and drawers, and sometimes even different space for different companies, a cubicle is needed.

Most existing cubicle systems are formed with partition walls that allow for smaller, individual office spaces to be created. These systems usually encompass short walls or panels that form a square or cube structure with at least one open side. This enables people to have their own small desk area for working, often with a computer, while not taking up a substantial amount of space in the building. These types of systems allow for more people to work in an open environment. These existing systems, however, do not offer the privacy of an enclosed office with walls. The panels that divide each work setting are usually short and do not offer privacy and security in the form of an enclosed roof with a door. Due to the low walls or partitions and the instability of the structures, it would not be possible to install a door. Lighting is also often an issue, as such open space systems do not include integral lighting. Permanent lighting needs to be installed over the workspaces.

Most existing systems are uniform and simple. The partition walls are commonly made of a metal frame material covered in fabric and many of these systems include attachable desks or furniture that match the partitions. In a large setting where many systems are placed, the area can appear dull and unattractive.

Existing partition systems may be attached in some locations to a permanent wall for stabilization. Some types of systems include a floor track that is set up first and then panels are inserted to create the desired shape of the work space. In many buildings with open areas in which existing systems are placed, concrete flooring may be uneven (sloped or wavy) causing the partitions to be lopsided and/or uneven. This can negatively impact the rest of the office system, causing any attached furniture or desks to be lopsided/uneven.

There is a need for a device and system that is easily installed in open spaces and adjustable to different configurations. There is a need for a device that allows for the location of privacy doors in any location on the structure, doors that can be closed and locked. There is a need for an adjustable open space office system that creates secure, private offices with closable and lockable doors, offices with walls that are tall and do not permit easy viewing inside over the top of the wall. There is a need for an open space adjustable office system that provides lighting for the space without installation of permanent light fixtures on the ceilings above the compartments/offices. There is a need for an easy to install and remove adjustable office system for open office spaces that is sturdy and strong. There is a need for a professional looking adjustable office system for creating office spaces within an open area that looks professional, including one with walls made, in part, from glass.

SUMMARY OF THE INVENTION

Applicant has invented a device and system for creating offices that overcomes these and other shortcomings. While the invention will be described in connection with certain embodiments, it will be understood that the invention is not limited to those embodiments. To the contrary, the invention includes all alternatives, modifications and equivalents as may be included within the spirit and scope of the present invention.

The present invention is an adjustable open space office system that creates one or more offices within an open space without the need for permanent walls and without the need for permanent light fixtures on the ceiling above. The invention is made from materials and in a manner that provides for the ability to include removable and replaceable component panels which function as walls, those panels including one or more panes of glass for a professional and elegant appearance. The invention allows for numerous spatial configurations and office sizes. The invention permits installation of one or more privacy doors in any location on the device. The invention also includes an up-lighting system integral and concealed within the top of the structure to provide lighting for the space(s).

The invention includes a main support frame/structure. Most preferably, the main support frame is constructed from steel but other materials of construction are also possible, such as, for example, plastics and woods, composites, and combinations thereof. The main support frame is a free standing structure comprising a top support member and support legs.

For example, in simplest form, the top support member could be a steel U-shaped bar configured into the space of a square with four sides connected together at welded corners creating a top support member. Alternatively, the corners of the top support member could be connected together in a removable fashion using bolts and nuts, screws and nuts, slots and fasteners (e.g., pins or bolts), and the like. Welded connections at corners and other parts where components of the main support connected together are preferred for a stronger and more sturdy installation. Removable and replaceable fastening systems such as bolts and nuts provide for easier installation and removability. The support legs are preferably steel columns located at each corner of the top support member. Each support leg is connected at one if its ends to a corner of the top support member, preferably at the underside of the top support member. A compactable embodiment of the invention includes pivoting connections between the top of each support leg and the top support member (e.g., using pins) so that the support leg can collapse during transportation prior to erection. Most preferably, but not necessarily, the width of the support leg is slightly narrower than the width of the main support member. The bottom of each leg support preferably includes one or more flanges that rests on the floor which helps to stabilize the leg on the floor. In one embodiment of the invention, the flange(s) at the bottom of the support leg includes bolt holes/apertures for securing the bottom of the support leg (flanges) to the floor using bolts, screws, anchors, or the like. It is preferred that each support leg have an about square cross sectional shape.

When the main support is constructed/put together with one end of each of the support legs attached to the top support member and the structure is placed in position on a floor with the bottom of each of the leg supports on the floor, the structure is self supporting. If needed and desired, the bottom of one or more support legs can be raised or lowered using shims or height adjustment screws to level the top support member.

Depending on the dimensions between support legs chosen, one or more individual panels/panes, or a door, can then be installed between leg supports.

Frames for the panels/panes are preferably constructed from steel but could also be made from other materials. The steel frame panels/panes are constructed with a tab on top such that the top of each panel/pane slides into a groove or channel on the underside of the top support member located between support legs thereby securing the top of each panel/pane in position at the top. Each panel/pane is tightened into position, and held more securely in position relative to the floor and the top support member, by lowering the threaded support screw(s) located at the bottom of each pane/panel. Raising each panel/pane for a tight fit between the floor and the underside of the top support member channel strengthens the entire structure, including each pane/panel. Preferably, but not required, each pane/panel includes a solid metal lower portion and a glass upper portion. The glass upper portion preferably including a lower opaque glass portion and a transparent upper glass portion.

The panels/panes can be made in any size, width and/or height. The heights of each panels/panes are made about equal in length (height) to the length (height) of the support legs, most preferably slightly less to allow height adjustment and securement using the threaded support screws on the panel/pane. Use of the threaded support screws at the bottom of the panels/panes provides the ability to adjust for an uneven or wavy floor.

Preferably, the height of the top of the main support is about 7 or 8 feet off of the finished floor. In areas with tall ceiling heights, e.g., 10 feet, the system results in an open top configuration which allows for air flow, and thus heating and air conditioning into and out of the compartment(s) yet functions like a completely enclosed office with walls.

Two or three different pre-set panel/pane widths, e.g., 24-inches, 36-inches, and 48-inches, enable different configurations for the resulting compartment(s) and for location(s) of openings for the doorway(s) into and out of the resulting offices/compartment(s).

The system provides for a doorway in the location(s) where no panel/pane is placed. A doorway can be left open and without any door, or a door can be included. The door according to the invention includes a barn door type roller support with wheels. The wheels for the barn door support rest on one side of the U-shaped top support member. When the door's roller support is on the U-shaped top support member, the door is able to travel the entire length of the top support member between support legs and in front of or in back of the panel/panes with minimal clearance, e.g, less than an inch of clearance.

In the preferred embodiment, once a doorway is selected and a door is installed, the travel path of the door can be limited by door stop pins or brackets on or in the U-shaped support member. Preferably, the front edge of the door is permitted to pass past the edge of the pane/panel such that a plunger lock can be used to lock the door in a closed position between a door stop and the edge of the pane/panel frame.

The system has an open top configuration with an upward lighting system integral to the top support member and inside it to provide upward lighting to the space(s). For example, an LED or florescent string light can be placed within the U-shaped top support member and connected/wired to an electrical junction box on an adjacent wall or support column.

BRIEF DESCRIPTION OF THE DRAWINGS

The accompanying drawings, which are incorporated in and constitute a part of this specification, illustrate embodiments of the invention and, together with the general description of the invention given above and the detailed description of an embodiment given below, serve to explain the principles of the present invention. Similar components of the devices are similarly numbered for simplicity.

FIG. 3 also shows the support groove into which a tab at the top of the panel is inserted.

FIG. 4 is an enlarged view of a portion of the device shown in FIG. 1 showing the bottom portion of one support leg and a bottom corner of a panel. A support flange with apertures is shown at the bottom of the support leg and a threaded support screw used for height adjustment is shown in the bottom of the outer frame of the panel.

FIG. 5 is an enlarged view of a portion of the device shown in FIG. 2 showing a corner of the top support member and the top of one support leg under a corner of the top support member. FIG. 5 also shows the U-shaped configuration of the top support member and the resulting channel therein.

FIG. 6 is a cross sectional view taken at line 6-6 in FIG. 5. FIG. 6 shows the channel in the U-shaped top support member with the lighting inside the channel. FIG. 6 also shows a partial cross section of the top of a pane including the support tab in the groove.

FIG. 7 is a cross sectional view taken at line 7-7 in FIG. 1. FIG. 7 shows the channel in the U-shaped top support member with the door and door mount bracket having rollers on a side of the U-Channel. FIG. 7 also shows a partial cross section of the top of a pane including the support tab in the groove.

DETAILED DESCRIPTION OF THE INVENTION

Reference is being made in detail to presently preferred embodiments of the invention. Selective embodiments are provided by way of explanation of the invention, which is not intended to be limited thereto. In fact, those of ordinary skill in the art may appreciate upon reading the present specification and viewing the present drawings that various modifications and variations can be made.

Figure 1:
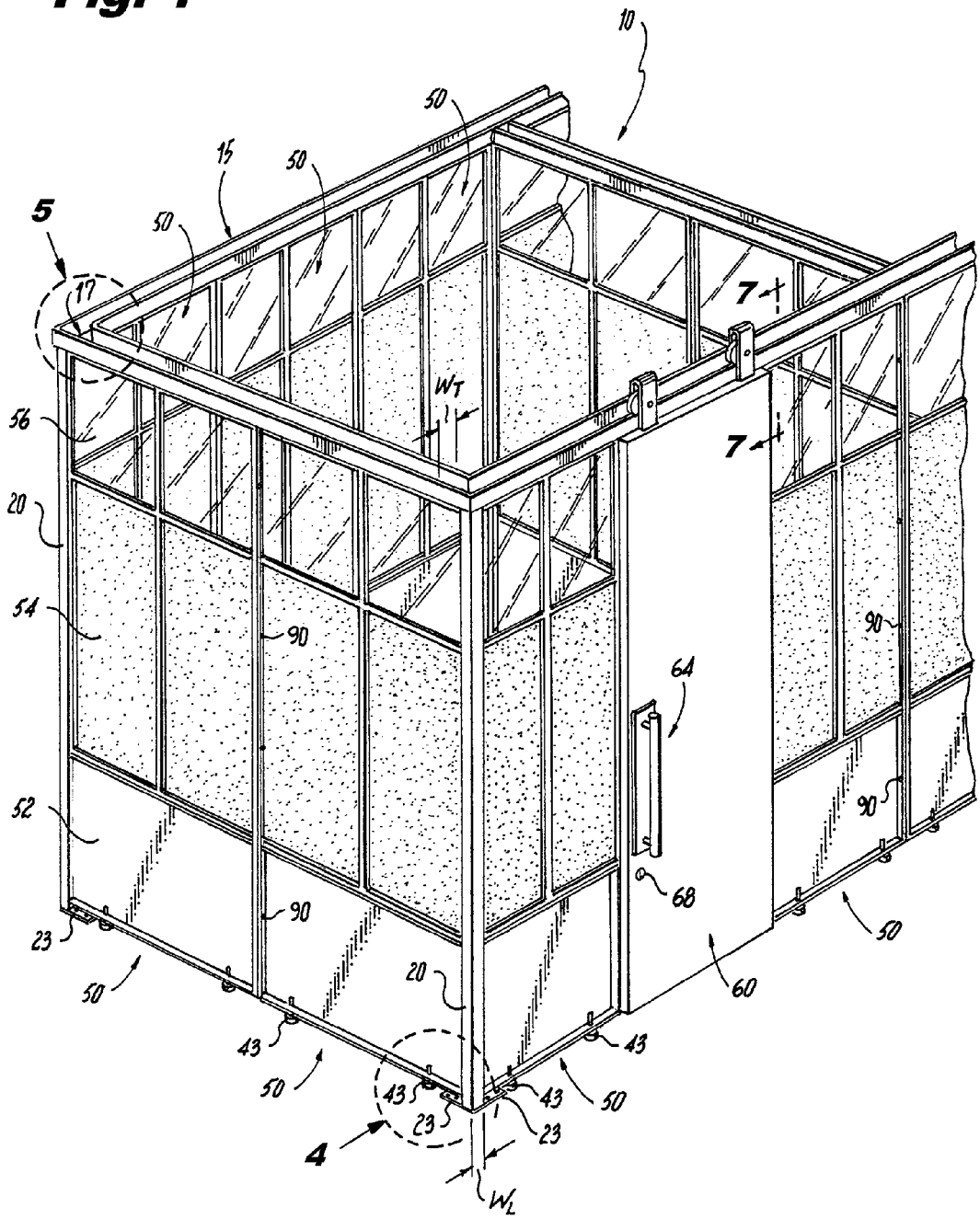
FIG. 1 is a perspective view of one embodiment of the invention shown in an assembled configuration with one office/compartment, one doorway with one door, two panels on two of the sides of the office/compartment, three panels on one side of the office/compartment, and two panels and a door on the other side of the office/compartment. The broken lines show that an indefinite number of additional office/compartments can be added and included.
Figure 2:
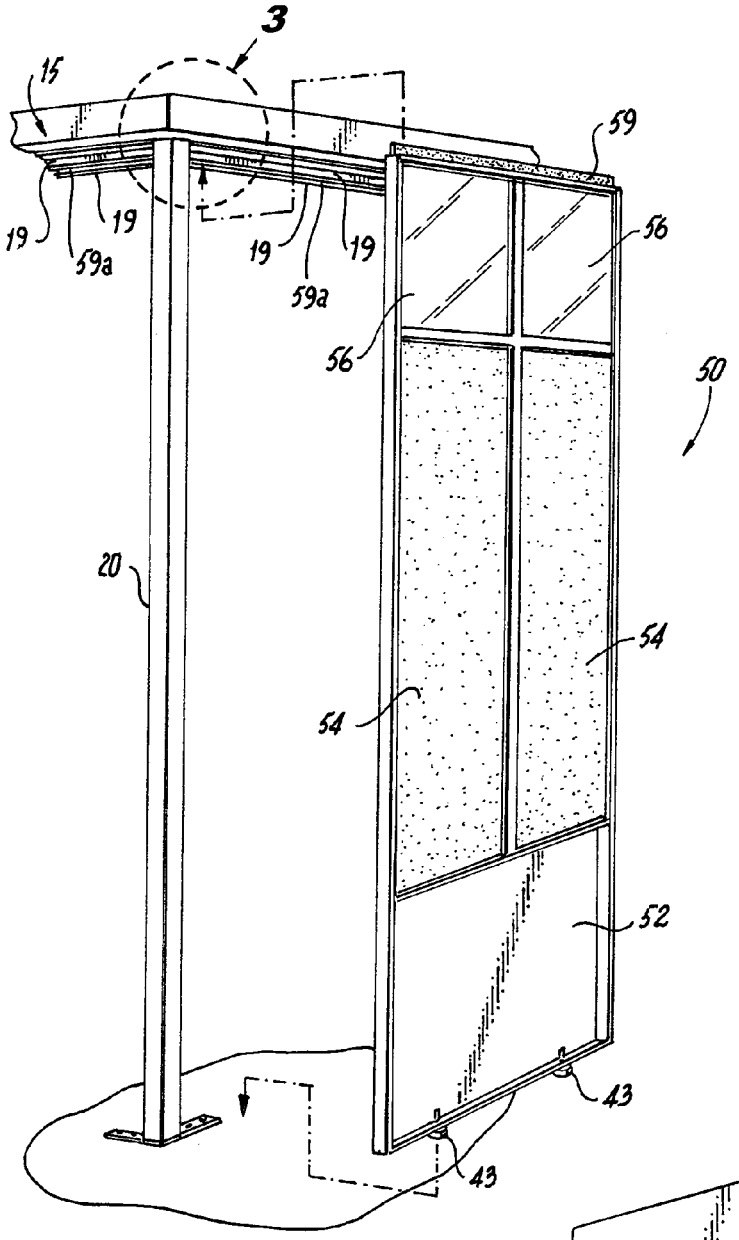
FIG. 2 is a perspective view of a portion of the device shown in FIG. 1 showing one front panel removed from the main support in an exploded view. The Figure shows the different sections of the panel separated from its frame. The threaded support screws used for height adjustment are shown in the bottom of the outer frame of the panel.
Figure 3:
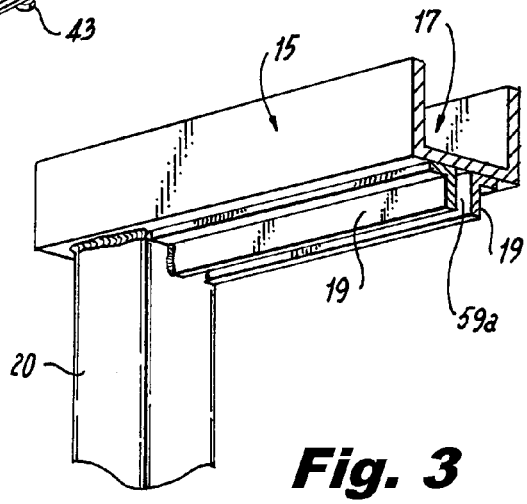
FIG. 3 is an enlarged view of a portion of the device shown in FIG. 2 showing the top support member and one support leg under a corner of the top support member.
Figure 8:
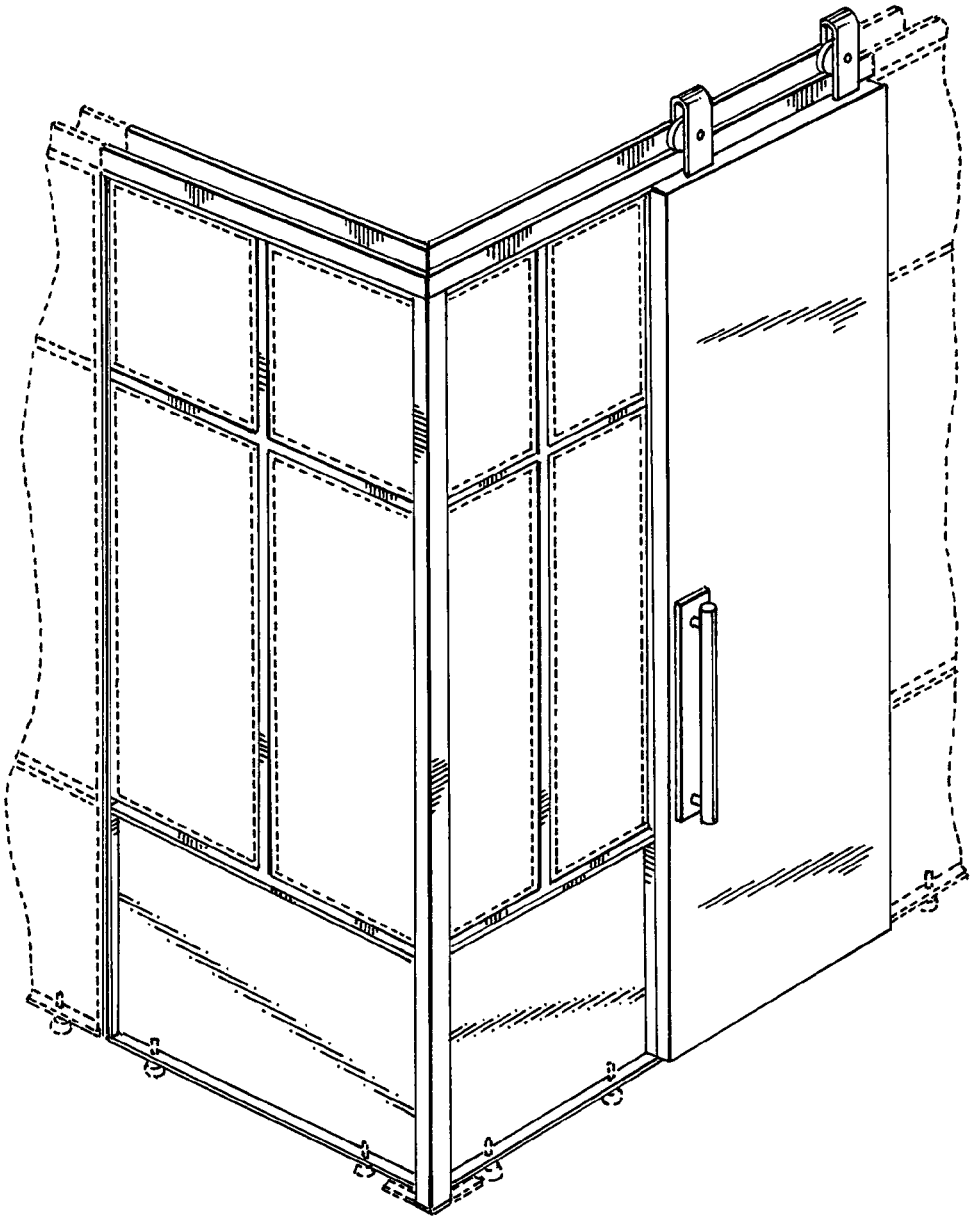
FIG. 8 is a front perspective view of a design for the invention. The dashed enclosed areas could include any design or material.
Figure 9:
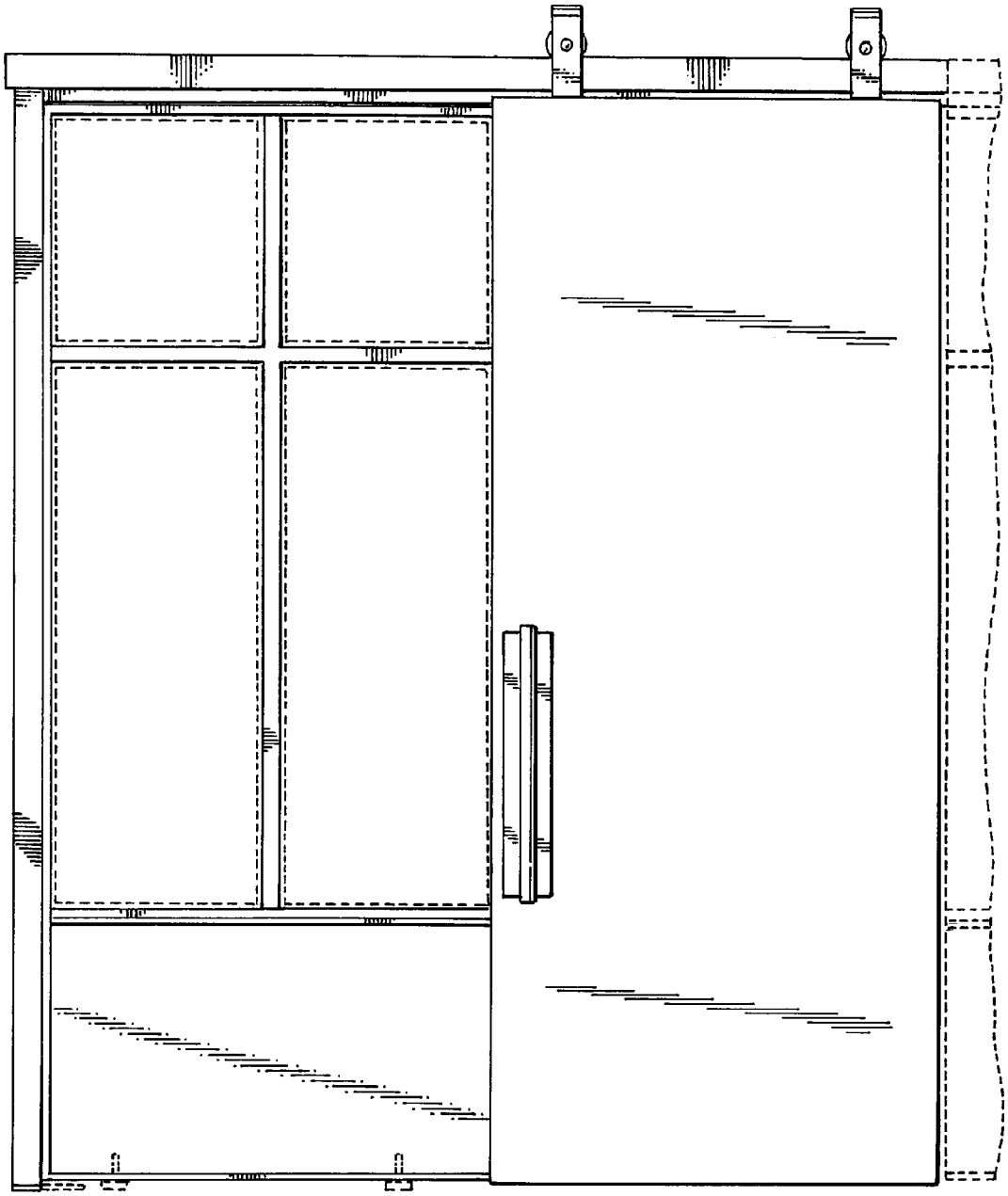
FIG. 9 is a front elevation view of the design shown in FIG. 8.
Figure 10:
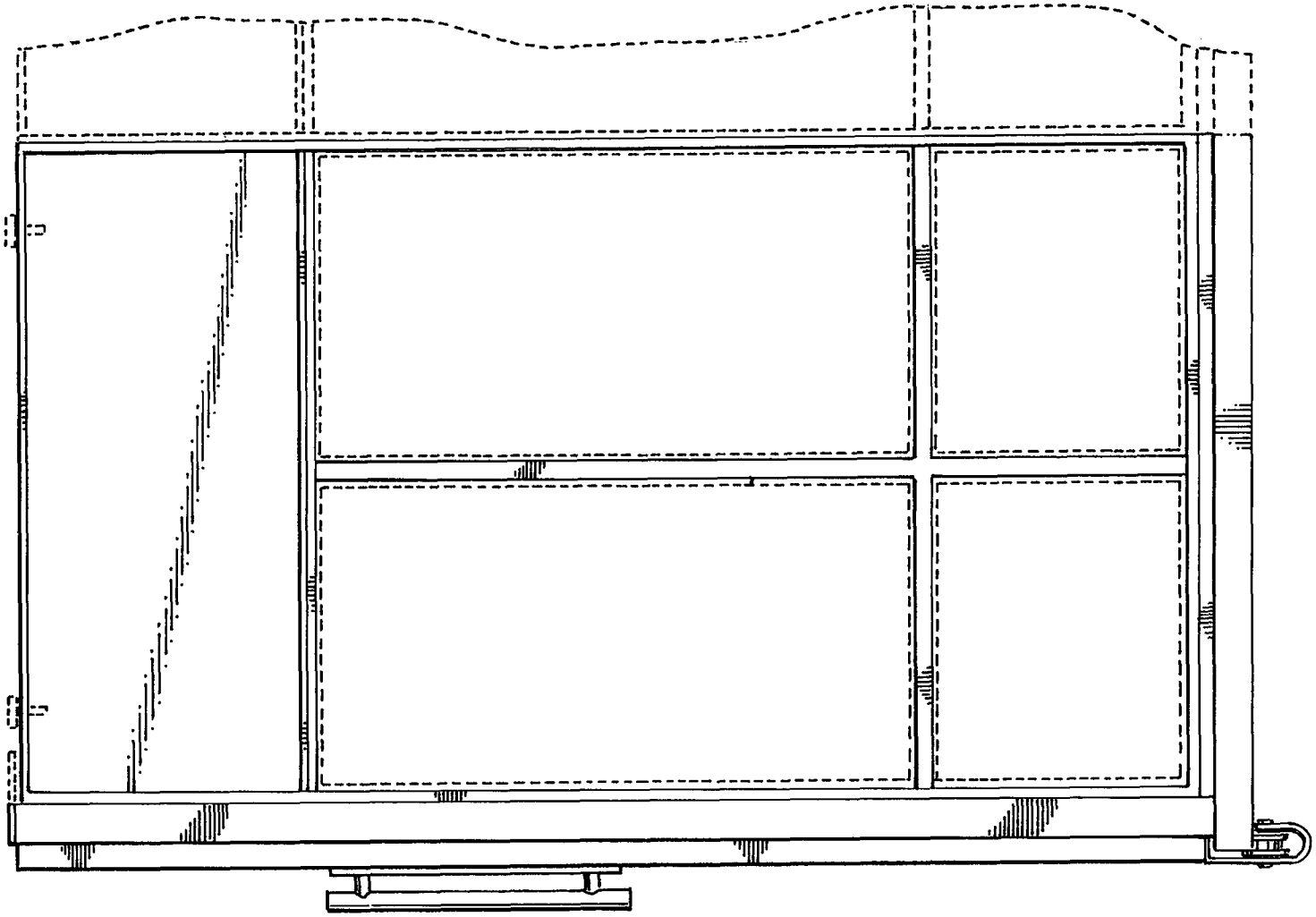
FIG. 10 is a left side elevation view of the design shown in FIG. 8.
Figure 11:
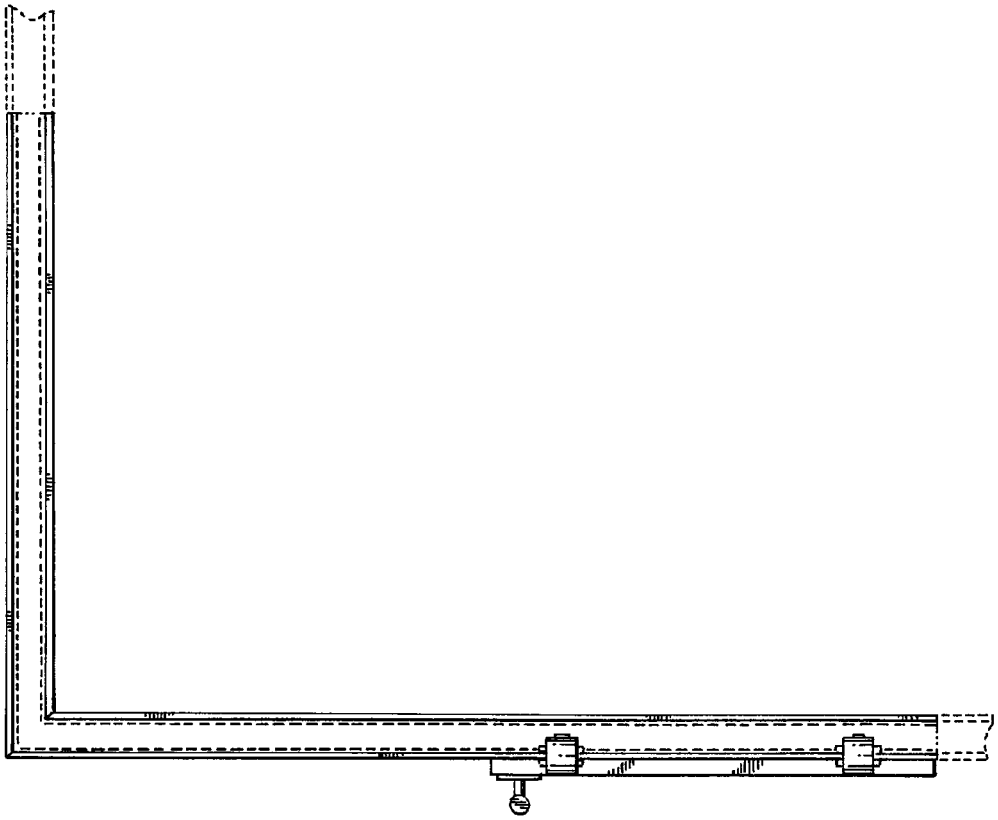
FIG. 11 is a top plan view of the design shown in FIG. 8.
Figure 12:
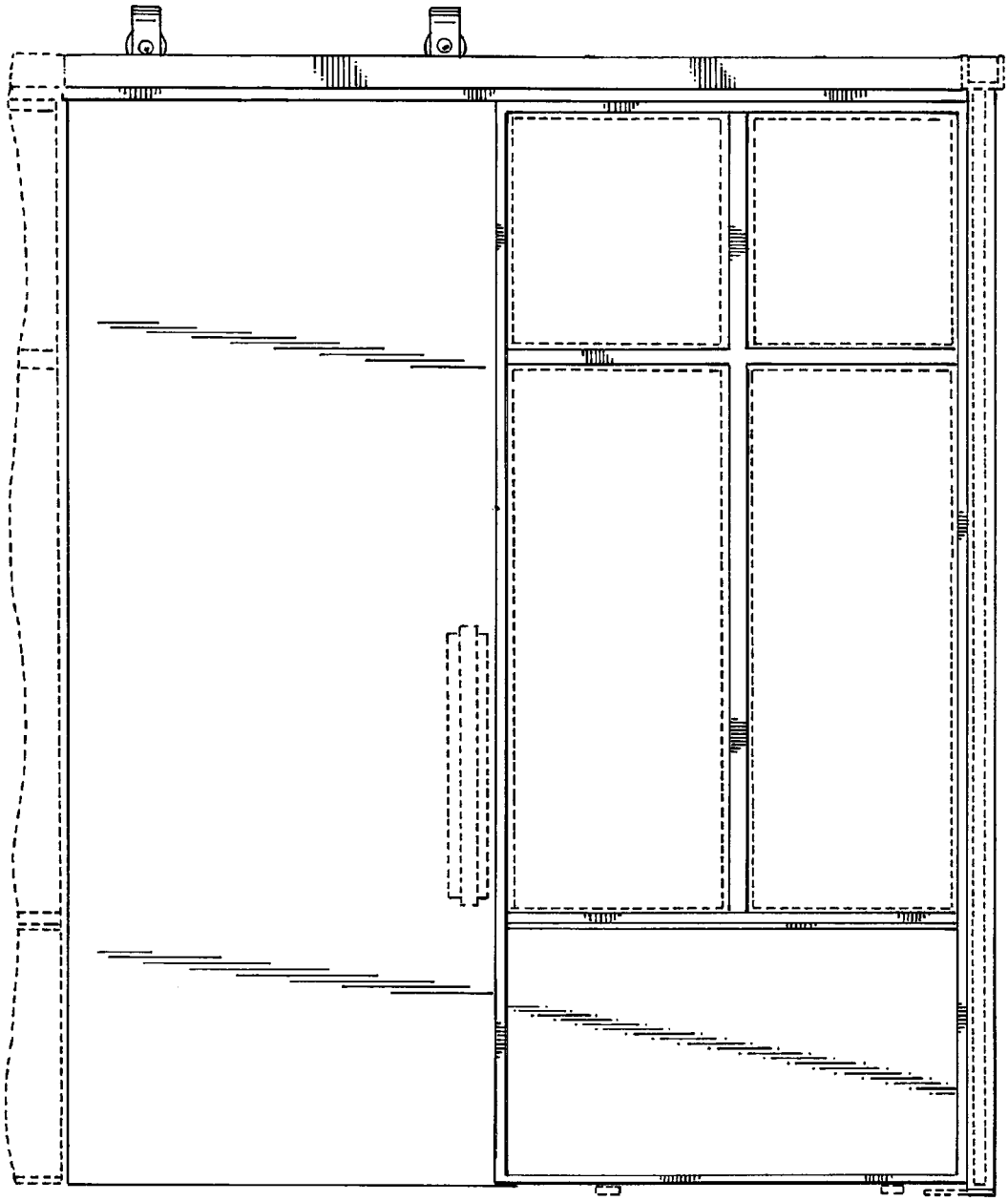
FIG. 12 is a right side elevation view of the design shown in FIG. 8.
Figure 13:
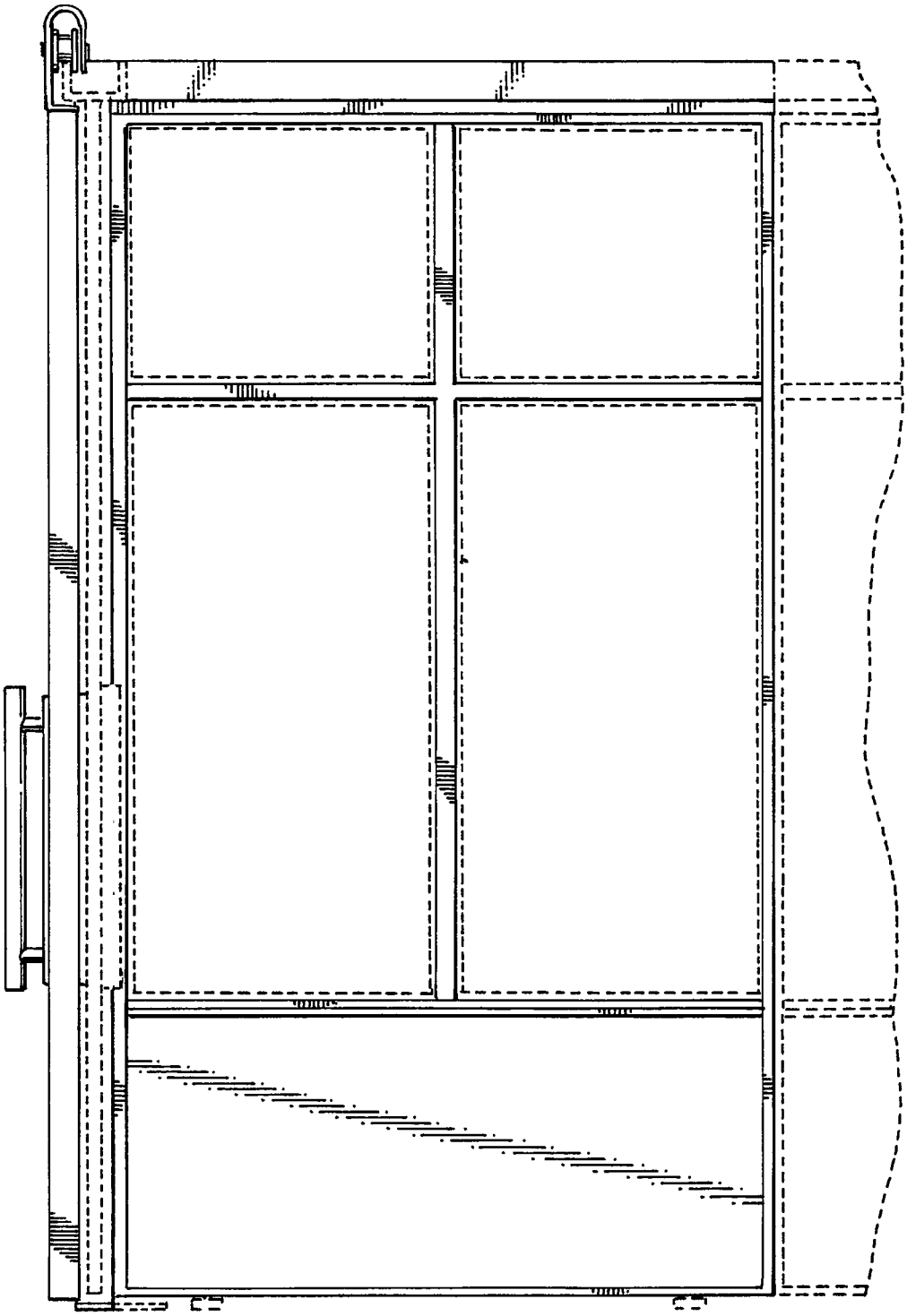
FIG. 13 is a rear elevation view of the design shown in FIG. 8.

FIG. 1 is a perspective view of one embodiment of the invention shown in an assembled configuration with one compartment (but showing the structure continues for additional compartments), one doorway and one door 60, two panels 50 on two of the sides of the compartment, three panels 50 on one side of the compartment (the side opposite the door), and two panels 50 and a door 60 on the other side of the compartment. In the embodiment shown in FIG. 1, each of the panels 50 include three sections, a lower section 52, a middle section 54, and an upper section 56. In FIG. 1, the lower section 52 is a opaque material (e.g., metal), the middle section 54 comprises two pieces of glass and the upper section 54 comprises two pieces of glass. Most preferably, the middle section 54 of each panel includes an opaque glass, e.g., frosted glass and/or wired glass as shown in the figures for privacy up to the height of the middle section within the compartment.

Top support member 15 is U-shaped in cross section with a bottom and two sides. It is shown in an about square (rectangular) shape with four straight pieces/sides connected together at welded mitered corners (welded butt end are also possible and included in the scope of the invention). The top support member 15 creates an open top compartment (without any ceiling on or within the top support member) with an upward facing U-channel/aperture 17 inside the top support member 15 formed by the two sides of the U-shaped top support member 15. Alternatively, the corners of the top support member 15 could be connected together in a removable fashion with bolts and nuts, screws and nuts, slots/groove and tabs or fasteners (e.g., pins or bolts), and the like. Welded or bolted connections at corners and other parts where parts/components of the invention connect to the main support are preferred for a stronger and more sturdy device. Removable and replaceable fastening systems such as bolts and nuts provide for easier installation and removability.

The support legs 20 are preferably steel columns located under each corner of the top support member 15. Each support leg 20 is connected at one end (its top) to a corner of the top support member 15, preferably at the underside of the top support member 15. For larger systems with larger dimensions (e.g., longer lengths of top support member 15), one or more additional support legs 20 may be included under a straight section of the top support member 15 for additional support. Most preferably as shown in FIGS. 1 and 6, but not necessarily, the width ($W_L$) of the support leg 20 is less than the width ($W_T$) of the top support member 15. The bottom of each support leg 20 preferably includes one or more flanges 23 as shown in FIG. 4 that rests on the floor. The support flange 23 helps stabilize the support leg 20 (and thus the device) on the floor. In one embodiment of the invention, the flange(s) 23 at the bottom of the support leg 20 include(s) bolt holes/apertures for securing the bottom of the support leg 20 to the floor using bolts, screws, anchors, or the like. It is preferred that each support leg 20 have an about square cross sectional shape but other cross sectional configurations are possible and included in the scope of the invention.

When the main support 10 is constructed with the support legs 20 attached to the top support member 15 and the main support structure 10 is placed on a floor with the bottom of the support legs 20 on the floor, the structure is self supporting. If needed and desired, the bottom of one or more support legs 20 can be raised or lowered using shims or height adjustment screws to level the top support member 15.

Depending on the dimensions between two support legs 15, one or more individual panels 50, or a door 60, or a door 60 and panels 50, can then be installed between support legs 20.

The panels 50 consist of a rectangular shaped frame, preferably constructed from steel/metal but it could also be made from other materials including composites. The top of each panel includes a tab 59, (if desired for a tighter fit, preferably including a felt or other compressive covering), that slides into a groove **59*a* in the underside of the top support member 15 between support legs 20. The groove 59*a* can be created as shown in FIG. 7 using L-brackets 19 attached to the underside/bottom of the top support member 15. Alternative embodiments include slots in the bottom of the U-channel into which tab(s) 59** are inserted.

When installing a panel 50, tab 59 is slipped into the groove **59*a*. The panel 50 is then plumbed beneath the top support member 15 and the foot supports 43 are lowered thus raising the top of the panel 50 up into the groove 59*a* against the top support member 15. Creating a tight fit for a panel 50 between the floor and the top support member 15 makes for a strong and secure structure. Where the outside frame of two adjacent panels 50 abut (meet) as shown in FIG. 1, fasteners can be added through holes/openings/apertures 90 in the frame of the panels 50** for securing two or more panels together.

In the preferred embodiment, the lower section 52 of a panel 50 includes a metal sheet, the middle section 54 includes an opaque glass, and the upper section 56 includes a clear glass. Most preferably, the height of the top of the middle section is at least six feet high so that people passing by cannot see into the compartment.

The panels 50 can be made in any size, width and height, although for a specific main support frame 10, the height of each panel 50 is made about equal in length (height) to the length (height) of the support legs 20, most preferably slightly smaller to allow height adjustment using the threaded support screws 43 at the bottom of the panel 50 frame. Use of the threaded support screws 43 at the bottom of the panels 50 also provides the ability to adjust for an uneven or wavy floor.

Preferably, the height of the top of the main support frame 10 is at least seven feet, more preferably seven or even eight feet, off of the finished floor. In areas with tall ceiling heights, e.g., 9 or 10 feet, the device creates an open top configuration with space between the top of the main support frame 10 and the ceiling which allows for air flow into and out of the compartment(s), and thus heating and air conditioning into and out of the compartment(s).

Two or three different panel 50 widths, e.g., 24-inches, 36-inches, and 48-inches, enable different configurations for the resulting compartment(s) and for location(s) of openings for the doorway into and out of the compartment(s).

The invention allows for the creation of a doorway in any location(s) under the main support frame between support legs 20 by simply leaving out a panel 50. A doorway can be left open without any door, or a door 60 can be included. The door 60 according to the invention includes a barn door type roller support with wheels 67 and an offset bracket support 63. The wheels 67 for the barn door support roll on the top of one side of the U-shaped top support member 15. When the wheels of the door's 60 roller support is on the U-shaped top support member 15, the door 60 is free to travel the entire length of the top support member 15 between support legs 20 and in front of (or in back of if desired) the panel(s) 50 with minimal clearance, e.g, less than an inch of clearance.

In the preferred embodiment, once a doorway location is selected and a door 60 is installed, the travel path of the door 60 on the top support member 15 can be limited by door stop pins or brackets on or in the U-shaped support member (not shown in the figures). Preferably, the front edge of the door is permitted to travel past the edge of the panel(s) 50 frame such that a plunger lock 68 can be used to lock the door 60 in a closed position between a door stop and the edge of the panel 50 frame.

The invention includes an upward lighting system integral to the top support member 15 and inside it to provide upward lighting to the space(s). For example, as shown in FIG. 6, an LED or florescent string light 80 can be placed within the U-shaped top support member 15 and connected/wired to an electrical junction box on an adjacent wall or support column (not shown).

We claim:

1. A device for creating offices in an open space comprising:

a self-supporting main support frame comprising:

a top support member configured in the shape of a rectangle having four sides and four corners, said top support member comprising a U-shaped cross sectional shape with an internal channel, a top, a bottom and two sides;

at least four support legs each having an about rectangular cross-sectional shape, a top and a bottom;

the bottom of said top support member at each corner of said rectangular configuration connected to the top of a support leg;

said bottom of said top support member between said support legs comprising a groove;

at least one panel comprising a rectangular shaped frame comprising at least three internal sections including a lower section, a middle section and an upper section; said upper section and said middle section comprising glass and said lower section comprising a metal sheet; wherein said glass in said middle section is opaque; said panel further comprising a tab at the top configured to insert into said groove on the bottom of said top support member; said panel further comprising at least two height adjustment screws on the bottom of said frame;

at least one door comprising a support bracket with rollers attached to the top of the door, wherein said position of said door is offset under said rollers, said rollers positioned on one side of said top support member.

2. The device according to claim 1, wherein each of said corners of said top support member comprise welded seams.

3. The device according to claim 1, wherein said frame of said panel further includes apertures configured to receive a fastener passed through said aperture for securing said panel to an adjacent panel containing an aligning frame aperture.

4. The device according to claim 1, wherein the height of said panels is about equal to the height of each leg support.

5. The device according to claim 1, wherein the height of said panels is less than the height of each leg support.

6. A device for creating offices in an open space comprising:

a self-supporting main support frame comprising:

a top support member configured in the shape of a rectangle having four sides and four corners, said top support member comprising a U-shaped cross sectional shape with an internal channel, a top, a bottom and two sides;

at least four support legs each having an about rectangular cross-sectional shape, a top and a bottom;

the bottom of said top support member at each corner of said rectangular configuration connected to the top of a support leg;

said bottom of said top support member between said support legs comprising a groove;

at least three panels, each panel comprising a rectangular shaped frame comprising at least two internal sections including a lower section and an upper section; said upper section comprising glass; wherein said glass in said upper section is opaque; said panel further comprising a tab at the top configured to insert into said groove on the bottom of said top support member; said panel further comprising at least two height adjustment screws on the bottom of said frame;

at least one door comprising a support bracket with rollers attached to the top of the door, wherein said position of said door is offset under said rollers, said rollers positioned on one side of said top support member; and a lighting fixture positioned within said channel of said U-shaped top support member for upward lighting.

7. The device according to claim 6, wherein each of said corners of said top support member comprise welded seams.

8. The device according to claim 6, wherein said frames of each of said panels further include apertures configured to receive a fastener passed through said aperture for securing said panel to an adjacent panel containing an aligning frame aperture.

9. The device according to claim 6, wherein the height of said panels is about equal to the height of each leg support.

10. The device according to claim 6, wherein the height of each of said panels is less than the height of each leg support.

11. The device according to claim 10, wherein the height of each of said panels is greater than seven feet.

12. The device according to claim 10, wherein the height of each of said panels is greater than eight feet.

13. The device according to claim 6, comprising at least two panels under at least three of the four sides of the rectangular shaped top support member.

14. The device according to claim 6, said door further comprising a plunger lock.

15. The device according to claim 6, further comprising door stops attached inside said channel in said top support member.

* * * * *